US005921595A

United States Patent [19]

Brackmann et al.

[11] Patent Number: 5,921,595

[45] Date of Patent: Jul. 13, 1999

[54] MOTOR-VEHICLE DOOR LATCH WITH SINGLE-HANDLE INSIDE ACTUATION

[75] Inventors: Horst Brackmann; Michael Strathmann, both of Velbert, Germany

[73] Assignee: Kiekert AG, Heiligenhaus, Germany

[21] Appl. No.: 08/933,687

[22] Filed: Sep. 19, 1997

Related U.S. Application Data

[63] Continuation-in-part of application No. 08/652,246, May 23, 1996, abandoned.

[30] Foreign Application Priority Data

May 24, 1995 [DE] Germany ..... 195 19 010

[51] Int. Cl.[6] ..... E05C 3/06

[52] U.S. Cl. ..... 292/216; 292/201; 292/DIG. 23

[58] Field of Search ..... 292/216, 225, 292/DIG. 23, DIG. 27, 336.3

[56] References Cited

U.S. PATENT DOCUMENTS

| | | | |
|---|---|---|---|
| 3,844,595 | 10/1974 | Meinow | 292/216 |
| 4,538,845 | 9/1985 | Yamada | 292/216 |
| 4,735,447 | 4/1988 | Kleefeldt | 292/216 |
| 4,929,007 | 5/1990 | Bartczak et al. | 292/336.3 |
| 5,035,452 | 7/1991 | Rogers | 292/216 |
| 5,439,261 | 8/1995 | O'Hare | 292/336.3 |
| 5,531,489 | 7/1996 | Cetnar | 292/225 |
| 5,653,484 | 8/1997 | Brackmann et al. | 292/216 |

FOREIGN PATENT DOCUMENTS

| | | | |
|---|---|---|---|
| 475037 | 7/1991 | European Pat. Off. . | |
| 3923726 | 1/1991 | Germany | 292/DIG. 23 |
| 4433994 | 3/1996 | Germany . | |

*Primary Examiner*—Steven Meyers
*Assistant Examiner*—Teri Pham
*Attorney, Agent, or Firm*—Herbert Dubno; Andrew Wilford

[57] ABSTRACT

A motor-vehicle door latch has a housing, a latching fork pivotal on the housing, and a release pawl pivotal on the housing between a latched position retaining the fork in a latched position engaged around a bolt and securing a motor-vehicle door closed and an unlatched position in which the fork can release the bolt and allow the door to open. An inside door handle can move between a center rest position, an end open position, and an end lock position. A bowden cable has a sheath fixed to the housing and a core having a pair of ends one of which is attached to the handle for displacement of another end of the core jointly with the door handle. A locking lever can pivot between a locked position and an unlocked position. A first actuating lever pivotal on the locking lever offset from its axis has one end connected to the other end of the cable core and an opposite end and a second actuating lever pivotal on the housing between an actuated and an unactuated position has a formation engageable with the opposite end of the actuating lever only in the unlocked position of the locking lever. Mechanism between the second actuating lever and the pawl displaces the pawl into the unlatched position on displacement of the second actuating lever into the actuated position.

4 Claims, 5 Drawing Sheets

MOTOR-VEHICLE DOOR LATCH WITH SINGLE-HANDLE INSIDE ACTUATION

CROSS REFERENCE TO RELATED APPLICATION

This application is a continuation-in-part of application Ser. No. 08/652,246 filed May 23, 1996 abandoned with a claim to the priority of German patent application 195 19 010.6 filed May 24, 1995 (now abandoned).

FIELD OF THE INVENTION

The present invention relates to a motor-vehicle door latch. More particularly this invention concerns such a latch that can be latched and unlatched as well as locked and unlocked from inside the vehicle by means of a single handle.

BACKGROUND OF THE INVENTION

A standard motor-vehicle door latch has a pivotal latching fork, a release pawl engageable with the fork and displaceable between a latched position retaining the fork in a latched position engaged around a bolt and securing a motor-vehicle door closed and an unlatched position in which the fork can release the bolt and allow the door to open, and a release lever engageable with the pawl for displacing it between its positions and formed with an elongated slot. An outside actuating lever is provided with an entrainment nose aligned with an end of the release-lever slot. Separate inside and outside locking levers are coupled to a main locking lever displaceable thereby between a locked and an unlocked position. A link lever pivoted on the main locking lever carries a coupling pin projecting through the slot and engageable with the entrainment nose on pivoting of the main locking lever into the unlocked position of the main locking lever and unengageable on pivoting of the main locking lever with the entrainment nose into the locked position of the main locking lever. An antitheft lever displaceable between on and off positions is operatively engageable in the on position with the main locking lever to retain it in the locked position.

Normally as described in German patent document 4,433,994 of Kleefeldt the outside actuating lever is connected to the outside door handle and the inside actuating lever with the inside door handle. The outside locking lever is operated by a lock cylinder on the door and the inside locking lever is connected to an inside knob or element. With this system the outside locking lever as well as the link lever decouple the actuating-lever system from the release lever in the locked position of the latch. Thus when locked the outside actuating lever can move but does nothing. The antitheft lever ensures when in the on position that when the door is locked it cannot even be opened by the inside handle.

In another system described in European patent 0,475,037 of Kaiser there is no separate inside locking element. Instead, the inside handle is moved in one direction to lock the door, that is to disconnect or block operation of the door by the outside door handle, and in the opposite direction to simultaneously unlock and unlatch the door.

SUMMARY OF THE INVENTION

A motor-vehicle door latch has according to the invention a housing, a latching fork pivotal on the housing, and a release pawl engageable with the fork and pivotal on the housing between a latched position retaining the fork in a latched position engaged around a bolt and securing a motor-vehicle door closed and an unlatched position in which the fork can release the bolt and allow the door to open. An inside door handle can move between a center rest position, an end open position, and an end lock position. A bowden cable has a sheath fixed to the housing and a core having a pair of ends one of which is attached to the handle for displacement of another end of the core jointly with the door handle. A locking lever can pivot about an axis fixed on the housing between a locked position and an unlocked position. A mechanism is engageable with the locking lever for displacing same into and out of the locked position. A first actuating lever pivotal on the locking lever offset from its axis has one end connected to the other end of the cable core and an opposite end and a second actuating lever pivotal on the housing between an actuated and an unactuated position has a formation engageable with the opposite end of the actuating lever only in the unlocked position of the locking lever. Mechanism between the second actuating lever and the pawl displaces the pawl into the unlatched position on displacement of the second actuating lever into the actuated position.

The invention is based on the recognition that simply by mounting the first actuation lever on the locking lever, rather than on the latch housing, it is possible to effectively uncouple it from the second actuation lever simply by pivoting the locking lever. The pivot of the first actuation lever is at an end of the locking lever so that when same is pivoted into the locked position, the other end of the first actuating lever is pulled back so it moves completely clear of the second actuation lever when pivoted. This mechanism is extremely effective and very inexpensive and simple to manufacture.

According to another feature of this invention interengaging formations are provided on the first actuating lever and the locking lever for displacing the locking lever into the locked position on displacement of the handle into the lock position. These formation include a nose at the one end of the first actuating lever and an abutment on the locking lever. Such a simple coupling is possible since the first actuation lever need only be effective on displacement in one direction to operate the second actuation lever. Thus even when the system gets old and worn and the parts do not move freely relative to each other, there is no significant stress on the cable in the return movement to the rest position for the handle. It is possible for the cable core to be effective as a pull or as a push for either position.

In accordance with the invention a coupling normally having a spring is braced between the first actuating lever and the locking lever for urging the locking lever into the unlocked position on displacement of the handle with the first actuating lever into the open position. Thus, the handle can be used to unlock the door also. According to the invention a central lock system has a drive connected to the locking lever serves for actuating same.

The latch has according to a further feature of the invention emergency unlocking mechanism operable for displacing the locking lever into the unlocked position. This makes it possible, for instance, to unlock the door from outside the car using the standard key cylinder even if the door latch is in the antitheft position and cannot be moved from this position, as for instance when the vehicle's battery dies.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
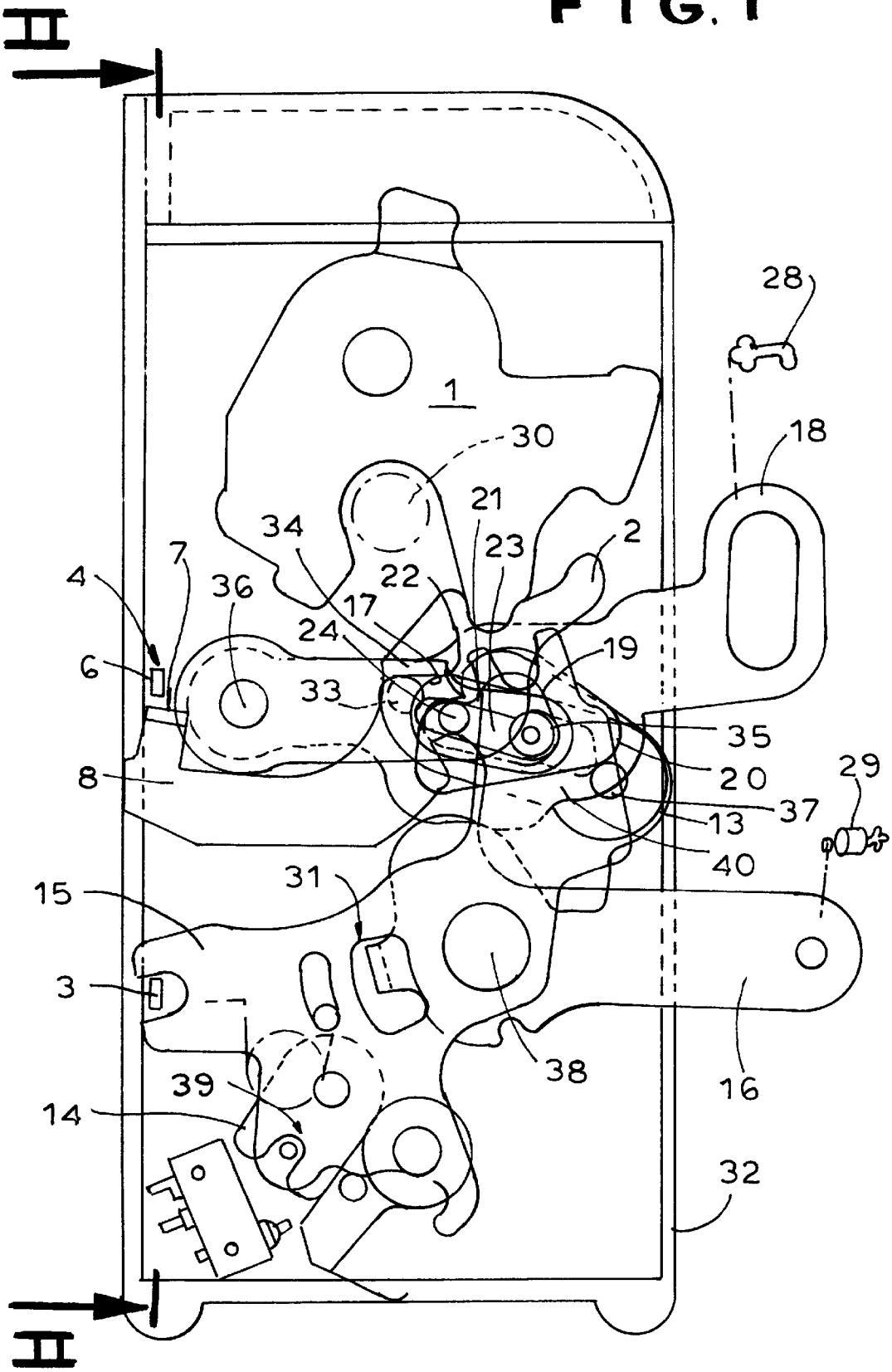
FIG. 1 is a side view partly in vertical section through the latch according to the invention.
Figure 6:
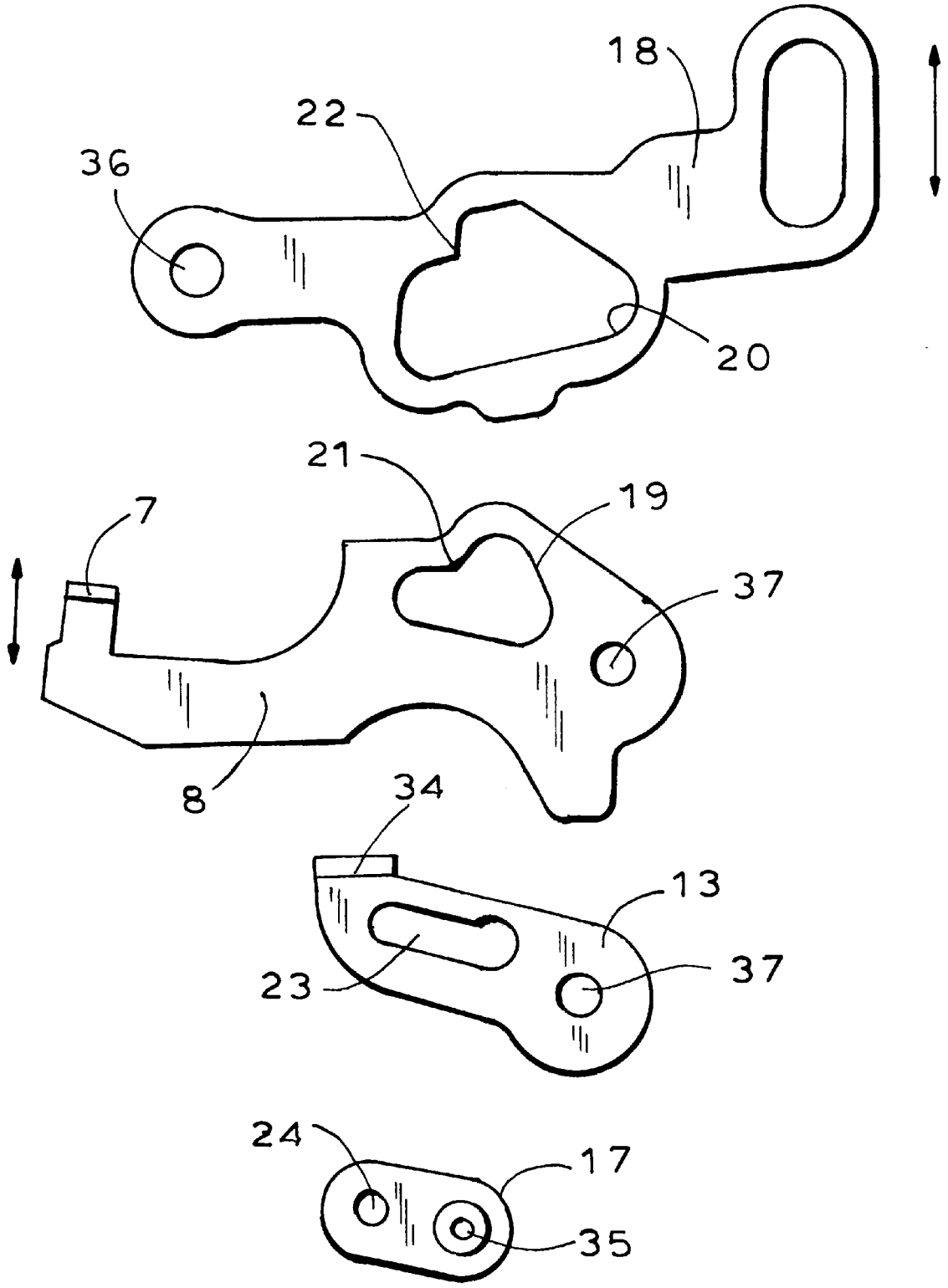
FIG. 6 is an exploded view of elements of the latch.

As seen in FIGS. 1 and 6 a door latch of the type generally described in copending application Ser. No. 08/647,440 filed May 7, 1996 (now U.S. Pat. No. 5,653,484 issued Aug. 5, 1997) and German 4,433,994 has a standard lock fork 1 pivotal on a latch housing 32 and engageable around a post-mounted bolt shown in dashed lines at 30. The latch has a conventional pawl 2 that is pivoted on the housing 32 at 36, that can hold the fork 1 in the illustrated retaining position, and from which extends a pin 33 that can be actuated by a bent-over tab 34 of a pivotal release lever 13 to release the fork 1 and allow the bolt 30 to be withdrawn from the latch. The release lever 13 is pivotal on the housing 32 at a pivot 37 and can in turn be operated by a coupling or link element 17 operable by an inside or second actuating lever 8 connected as described below to an inside door handle 27 (see FIG. 2) and by an outside actuating lever 18 connected to an outside door handle 28. This lever 8 is also pivotal about the pivot 37. The inside and outside actuating levers 8 and 18 have respective aligned and throughgoing cutouts 19 and 20 provided with respective entrainment formations or noses 21 and 22 that are also aligned axially, that is relative to the axes defined by the pivots 36 and 37. The release lever 13 is formed with a slot 23 extending longitudinally of itself, with the noses 21 and 22 aligned with one end of this slot 23.

A locking-lever system has a main locking lever 15 pivoted at 38 on the housing 32 and connected via a lost-motion coupling 31 to an outside locking lever 16 in turn operated by a lock cylinder 29 accessible from outside the door. The lever 15 is also operable by an inside locking lever 3 as will be described below.

Figure 7:
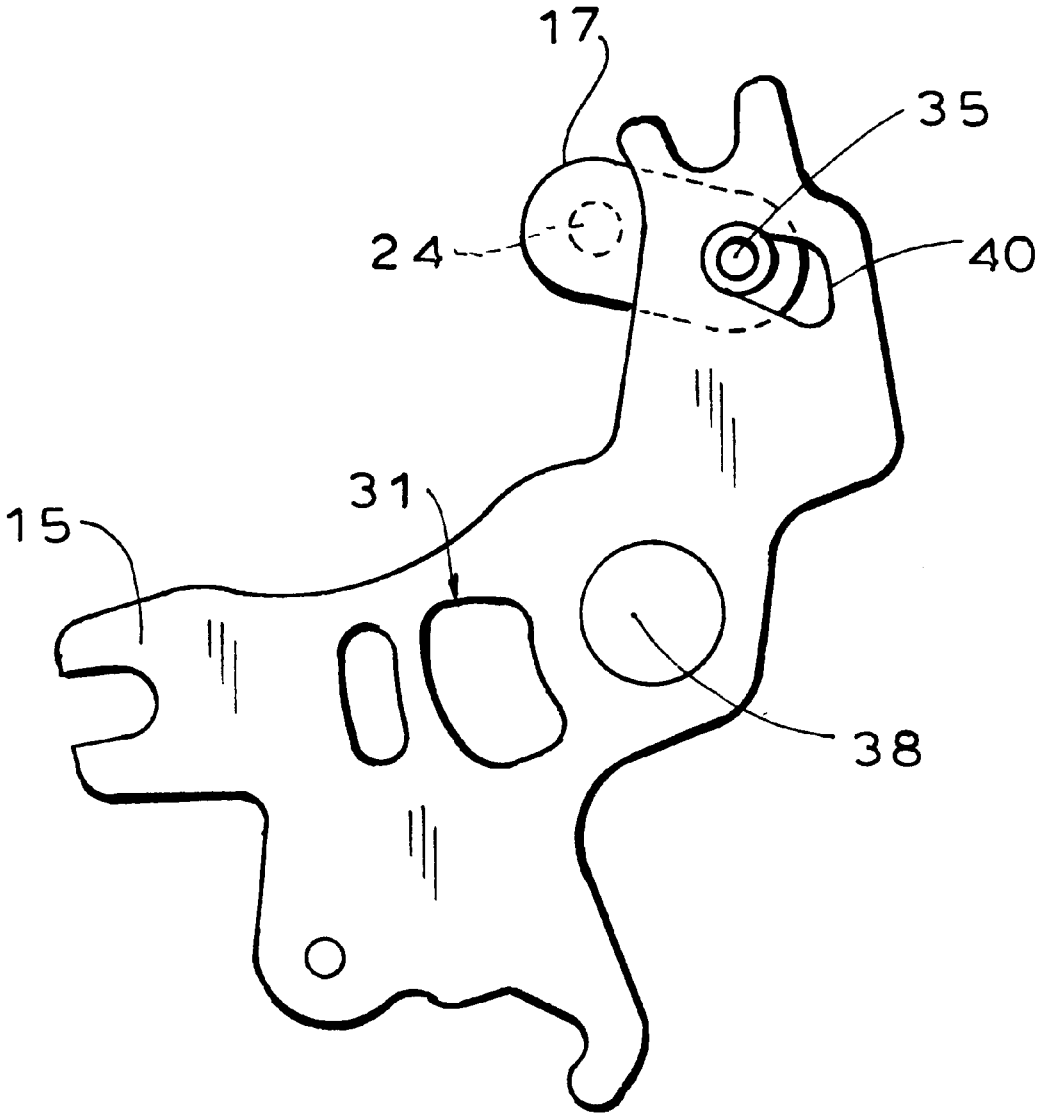
FIG. 7 is a detail view of the main locking lever and link element.

The link element 17 carrying a coupling pin 24 is mounted via a pivot 35 slidable in a slot 40 formed in the main locking lever 15 (see FIG. 7) with this pin 24 extending through the two cutouts 19 and 20 as well as through the slot 23. When the pin 24 is in the unlocked position (toward the left in FIG. 1) it couples the levers 8 and 18 to the lever 13 so that actuation of either lever 8 or 18 moves the pin 24 down, thereby pivoting down the tab 34 of the lever 13 to engage the pin 33 of the pawl 2 and thereby open the latch. When the pin 24 is in the opposite end or locked position (toward the right as seen in FIG. 1), as the levers 8 and 18 are actuated the pin 24 will stay stationary in the larger right-hand ends of their cutouts 19 and 20, that is past the entrainment noses 21 and 22, decoupling the levers 8 and 18 from the lever 13 so that their actuation does not unlatch the door. Attention is directed here to FIG. 1 of above-cited German 4,433,944 which shows a nearly identical system.

There is also a lever 14 coupled at 39 to the main locking lever 15 and which can displace the main locking lever 15 into the unlocked position.

Figure 2:
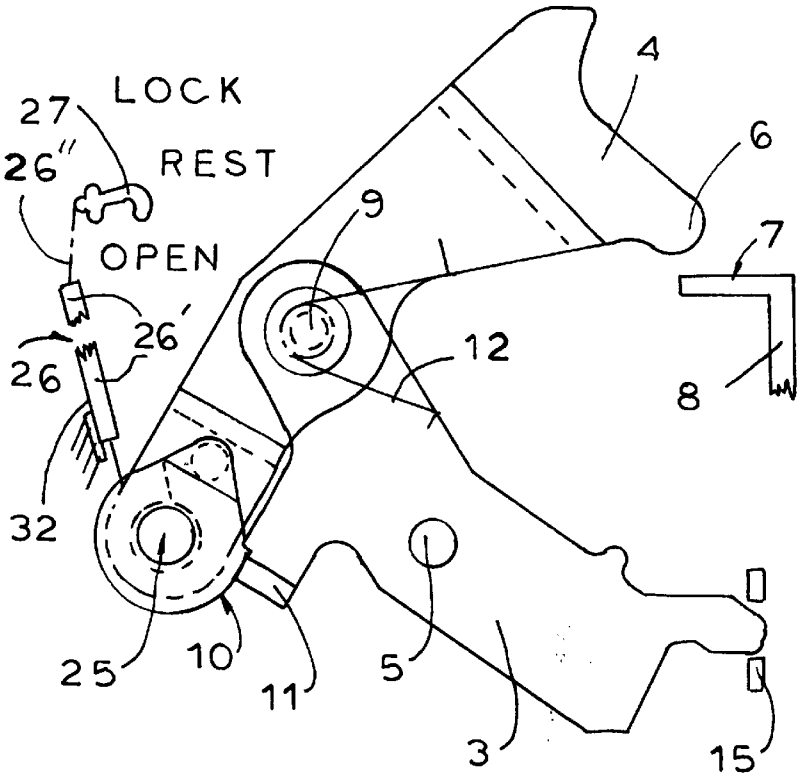
FIG. 2 is a section taken along line II—II of FIG. 1 with the inside locking levers in the unlocked position and the inside door handle in the rest position.

As better shown in FIG. 2, the inside handle 27 is connected to the core 26 of a two-way bowden cable 26 whose sleeve 26' is fixed on the housing 32. The core 26" of this cable 26 is connected at 25 to one end of a two-arm first actuating lever 4 pivoted at 9 on an end of the locking lever 3 pivoted at 5 on the latch housing 32. The other end of the lever 3 is fitted to a notch in the end of the main locking lever 15. The other end of the lever 4 has a formation 6 engageable with a flange 7 of the inside actuating lever 8. A torque spring 12 urges the lever 4 into a position out of engagement with the lever 8 and with the handle 27 in a rest position. The lever 4 has a surface 10 engageable with an abutment 11 on the lever 3.

Figure 3:
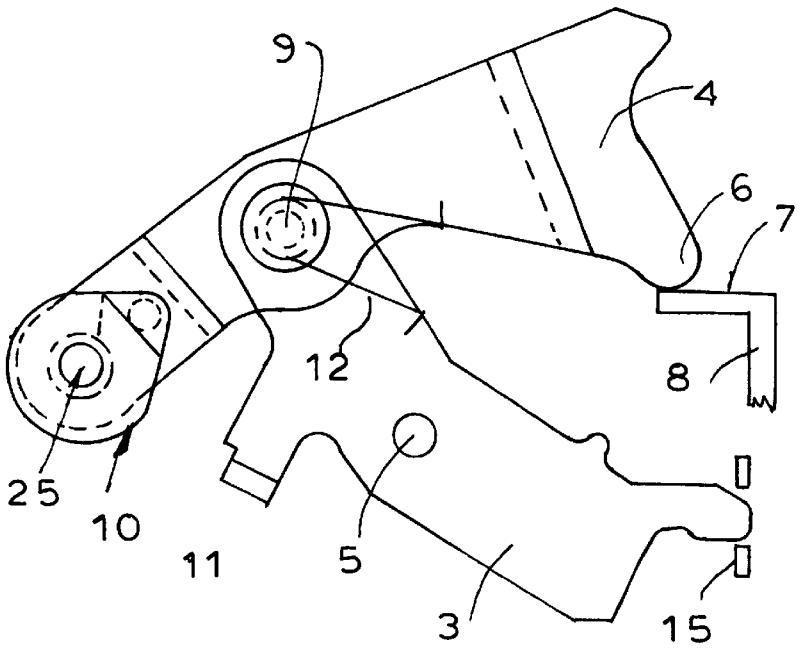
FIG. 3 is a view like FIG. 2 but with the inside locking lever in the unlocked position and the inside handle in the actuated open position.

More particularly, FIG. 2 shows the levers 4 and 8 in the unactuated positions and the levers 3 and 15 in the unlocked position. If the handle 27 is pivoted from its rest position this will pivot the lever 4 clockwise about its pivot 9 on the lever 3 and will cause its end 6 to engage the flange 7 and displace the lever 8 into the actuated position, opening the latch, moving the structure into the position of FIG. 3.

Figure 5:
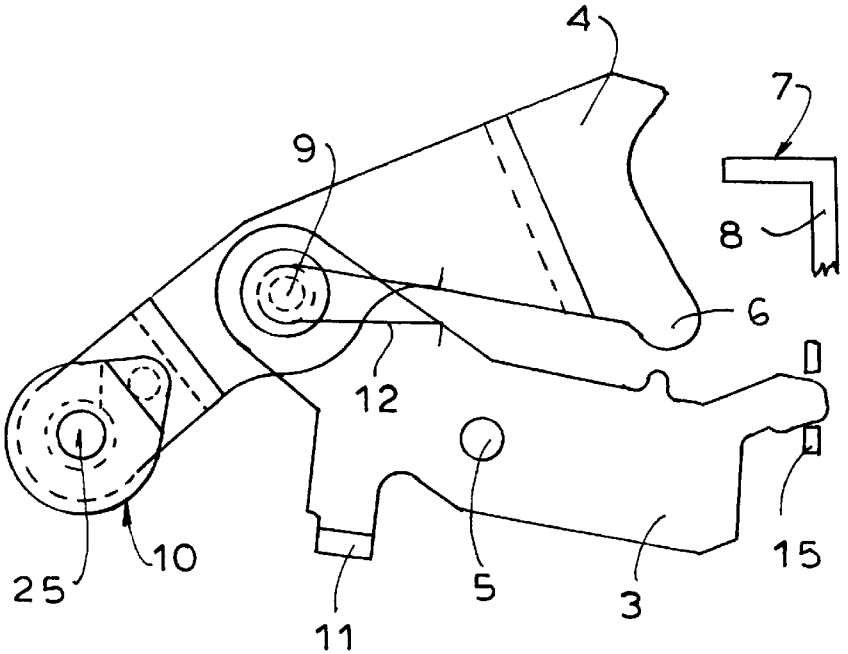
FIG. 5 is a view like FIG. 2 but with the inside locking lever in the locked position and the inside handle in the actuated position.
Figure 4:
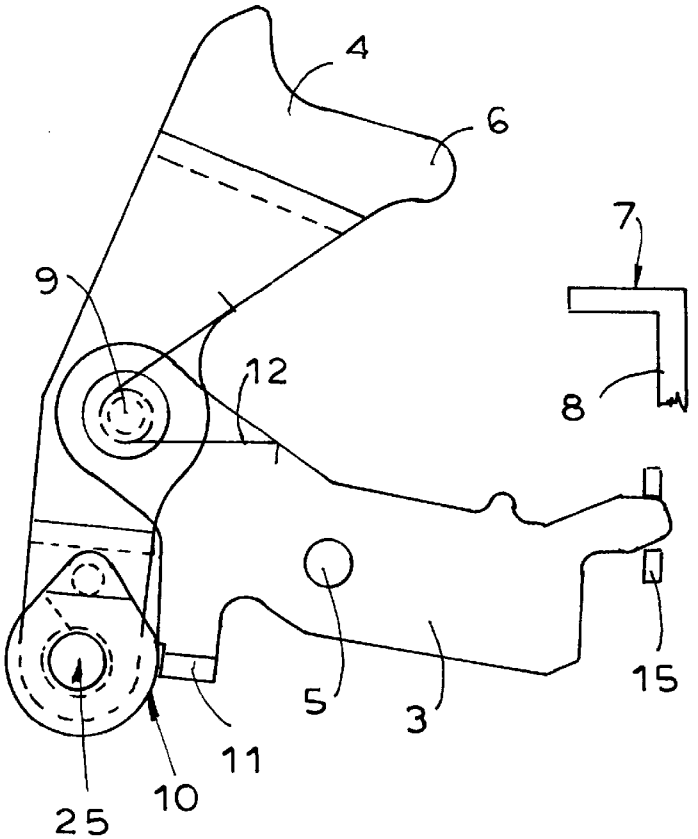
FIG. 4 is a view like FIG. 2 but with the inside locking lever and the inside handle both in the locked position.

On the other hand the lever 3 can be displaced into its locked position in either of two ways. The handle 27 can be moved into the locked position to pivot down the lever 4, thereby pushing the surface 10 against the abutment 11 and pivoting the lever 3 counterclockwise so it pivots the lever 15 into the locked position, as illustrated in FIG. 4. Alternately the outside door cylinder 29 can pivot the lever 16 which is coupled at 31 to the lever 15 which will in turn pivot the lever 3 counterclockwise into the locked position. When in this position as illustrated in FIG. 5, actuation of the inside handle 27 will pivot the lever 4 but its end 6 will be unengageable with the lever 8 and will simply move past it, leaving the door latched. Alternately the lever 15 could be split into two coaxial levers linked together by a spring.

The spring 12 serves, to couple the levers 4 and 3 together such that actuation of the lever 4 by the handle 27 into the open position will pivot the lever 3 back into the unlocked position and allow the latch to be opened.

The lever 16 is coupled to the latch mechanism such that the cylinder 29 can trip the latch into the unlocked position.

We claim:

1. A motor-vehicle door latch comprising:

a housing;

a latching fork pivotal on the housing;

a release pawl engageable with the fork and pivotal on the housing between a latched position retaining the fork in a latched position engaged around a bolt and securing a motor-vehicle door closed and an unlatched position in which the fork can release the bolt and allow the door to open;

an inside door handle displaceable between a center rest position, an end open position, and an end lock position;

a bowden cable having a sheath fixed to the housing and a core having a pair of ends one of which is attached to the handle for displacement of another end of the core jointly with the door handle;

a locking lever pivotal about an axis fixed on the housing between a locked position and an unlocked position;

means engageable with the locking lever for displacing the locking lever into the locked position;

a first actuating lever pivotal on the locking lever offset from its axis and having one end connected to the other end of the cable core and an opposite end;

a second actuating lever pivotal on the housing between an actuated and an unactuated position and having a formation engageable with the opposite end of the first actuating lever only in the unlocked position of the locking lever; and mechanism between the second actuating lever and the pawl for displacing the pawl into the unlatched position on displacement of the second actuating lever into the actuated position.

2. The motor-vehicle door latch defined in claim 1 further comprising means including interengaging formations on the first actuating lever and the locking lever for displacing the locking lever into the locked position on displacement of the handle in to the lock position.

3. The motor-vehicle door latch defined in claim 2 wherein the interengaging formations include a nose at the one end of the first actuating lever and an abutment on the locking lever.

4. The motor-vehicle door latch defined in claim 1, further comprising spring means braced between the first actuating lever and the locking lever for urging the locking lever into the unlocked position on displacement of the handle with the first actuating lever into the open position.

* * * * *